US007334546B2

(12) United States Patent
Rasmussen

(10) Patent No.: US 7,334,546 B2
(45) Date of Patent: Feb. 26, 2008

(54) CYLINDER LINER

(75) Inventor: Robert Rasmussen, Henderson, NV (US)

(73) Assignee: IPD Corporation, Torrance, CA (US)

( * ) Notice: Subject to any disclaimer, the term of this patent is extended or adjusted under 35 U.S.C. 154(b) by 0 days.

(21) Appl. No.: 11/093,786

(22) Filed: Mar. 31, 2005

(65) Prior Publication Data

US 2006/0219192 A1 Oct. 5, 2006

(51) Int. Cl.
*F02F 1/10* (2006.01)

(52) U.S. Cl. ..... 123/41.84; 29/888.1; 148/570

(58) Field of Classification Search ..... 123/41.84, 123/41.83; 29/888.1; 148/570, 571, 320–337
See application file for complete search history.

(56) References Cited

U.S. PATENT DOCUMENTS

| | | | | |
|---|---|---|---|---|
| 2,604,419 A * | 7/1952 | Herbenar | ..... | 148/567 |
| 2,926,112 A * | 2/1960 | Highfield | ..... | 148/571 |
| 6,116,198 A * | 9/2000 | Kirtley et al. | ..... | 123/41.84 |
| 7,162,798 B2 * | 1/2007 | Westra | ..... | 29/888.061 |

* cited by examiner

*Primary Examiner*—Stephen K. Cronin
*Assistant Examiner*—Katrina B. Harris
(74) *Attorney, Agent, or Firm*—Wegman, Hessler & Vanderburg

(57) ABSTRACT

A ductile repair cylinder liner for a diesel engine, the cylinder liner having an additional cooling groove with a parabolic varying cross-section machined into the outer surface of the cylinder liner immediately below the radially extending locating flange for the liner.

23 Claims, 5 Drawing Sheets

CYLINDER LINER

FIELD TO WHICH THE INVENTION RELATES

This invention relates to a coolant circulation groove in a cylinder liner for the passage of cooling liquids in internal combustion engines together with the method of manufacture thereof.

BACKGROUND OF THE INVENTION

Internal combustion engines are efficient ways of creating power in movable and fixed applications. Examples of the former include vehicles such as trucks, tractors and boats. Examples of the latter include generators, pumps, welders and the like.

A substantial after-market has developed for repair and rebuilding of these engines, with normal wear on removable parts like liners, piston rings, and bearings. These parts have to be periodically replaced in order to maintain the service life of individual engines.

With newly formulated low emission fuels, increasing compression ratios, boost pressures, operating temperatures, exhaust gas recirculation, speeds and other parameters, an efficient way of providing cooling for the parts associated with combustion is becoming more important, particularly at the critical location near the top of the cylinder liner surrounding the combustion chamber at the firing zone.

There have been many attempts to provide such cooling in engines. Examples include: 1) the shunt flow cooling system utilized in the Detroit Diesel Corporation internal combustion engines; 2) the ring flange cooling system utilized in Mercedes engines; and, 3) the lubrication oil cooling circuit used by Cummins Engine Company. A Detroit diesel engine is set forth in U.S. Pat. No. 5,299,538 while examples of the latter two are set forth in U.S. Pat. Nos. 3,363,608 and 4,413,597, respectively.

The cylinder liners now sold for use with these types of engines are typically made of chilled cast iron with a thorough hardness on the range of 45-47 Rockwell C. This hardness, while providing a hard running surface for a piston utilized with the liner, renders the liner stiff and non-compliant. It also requires grinding or honing for any post-hardening manufacturing procedures.

SUMMARY OF THE INVENTION

The present invention is directed to a cylinder liner having a curved cross-section circulation cooling groove located neighboring the top flange for the cylinder liner, thus to extend the effective volume of the cooling chamber higher on the cylinder liner in respect to the combustion zone. This improves the heat transfer between the cylinder liner and the surrounding coolant at this critical location. Further, since there are no corners to define fluid eddy areas, all of the groove is utilized for heat transfer. In addition, the liner is induction hardened primarily on the inner piston running surface. This facilitates manufacture of the liner and its curved cooling groove as well as providing for a liner which is more adaptable to movement of parts in the associated engine (i.e., block, head, etc.).

OBJECTS OF THE INVENTION

It is an object of this invention to improve the equalization of temperature at the upper end of a cylinder liner of an internal combustion engine;

It is another object of this invention to enhance cooling of the top end of a cylinder liner;

It is a further object of this invention to provide for a stronger cylinder liner that is more adaptable to the movement of the block and the head while the engine is running;

It is an yet a further object of this invention to increase the service life of cylinder liners;

It is still another object of this invention to lower the cost of cylinder liners;

It is yet another object of this invention to reduce the number of manufacturing operations to build a cylinder liner;

It is still a further object of this invention to allow complex cooling grooves to be utilized in engine cylinder liners;

Other objects of the invention and a more complete understanding of the invention may be had referring to the drawings in which:

DETAILED DESCRIPTION OF THE INVENTION

Figure 1:
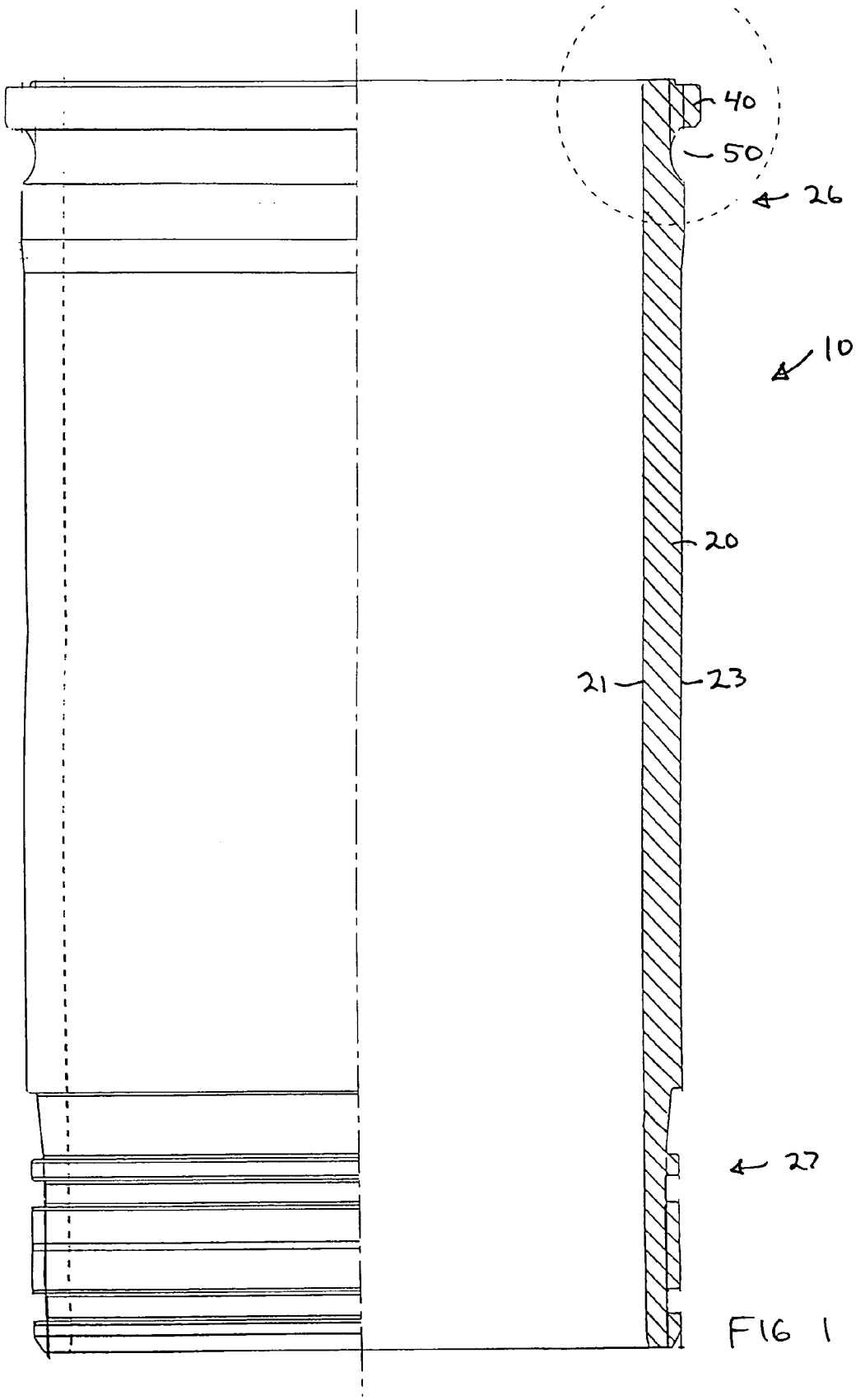
FIG. 1 is a cross-sectional view of a cylinder liner incorporating the present invention in an internal combustion engine.
Figure 2:
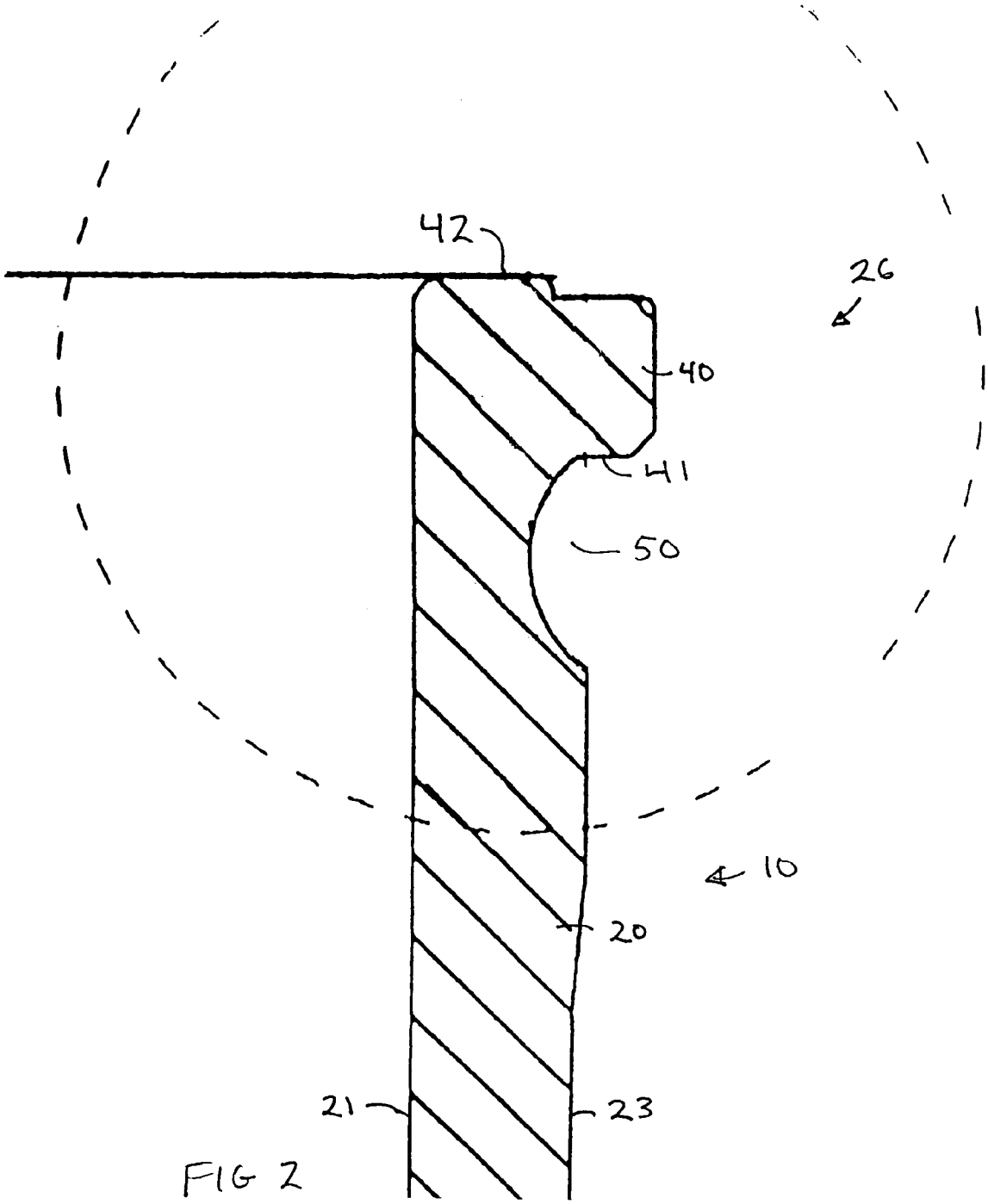
FIG. 2 is an enlarged drawing of the top cross-section of a cylinder liner of FIG. 1.

This invention relates to an improved cylinder liner for use in internal combustion engines. An example would be to utilize the liner in an after-market repair of a Detroit diesel 60 or 70 series engine.

The cylinder liner 10 itself includes a wall 20 extending off of a radially extending flange 40.

The cylinder liner 10 is designed to be pressed into a cylinder block 11 in a-known manner. The cylinder liner 10 thereafter cooperates with the cylinder head 12 and the piston 13 so as to create the combustion chamber for the engine. In the diesel engine shown, the engine uses direct injection with the combustion chamber 14 being supplemented by a swirl chamber in the piston (preferred) or head in order to optimize the apparent combustion chamber of the engine while simultaneously providing for a physical clearance for an injector and an auxiliary start glow plug that may be incorporated into high compression diesel engines. This allows a minimum clearance between the top of the piston and cylinder head (0.002 shown). The direct injection itself is electronically metered by the injectors from a 5,000 PSI common rail to each individual combustion chamber. The actual injection is amplified from 15,000 PSI to 30,000 PSI by a small piston in the injector in the process of injection.

The wall 20 of the cylinder liner is a narrow member extending circumferentially around the piston 13 between such piston 13 and the cylinder block 11. The inner-surface 21 of the wall 20 is in continual contact with the outer surface of the piston 13 throughout the entire range of such pistons stroke. This seals and physically guides such-piston in a manner known in the art. In order to provide for efficient sealing in cooperation with the rings of the piston 13, the inner-surface 21 of the cylinder liner 10 is machined throughout the entire range of contact of the piston 13 so as to provide for an efficient sealing at this location while allowing for the reciprocal motion of the piston 13 in respect to the cylinder liner 10. The inner surface 21 of the wall 20 of the liner 10 in the preferred embodiment of the invention is hardened to increase the in-service longevity of the liner by providing a wear-resistant surface for the piston to reciprocate thereon.

In the preferred embodiment disclosed, the hardening is accomplished by induction hardening only the inside or inner surface of the wall 20 to a limited depth. This produces a liner having a differential of hardness through the thickness of the wall thereof. Further, the liner can also have differential hardening that varies along its length, in specific raising the hardness of the wall of the liner as it approaches its top end in the flange/combustion area of such liner.

The differential of hardness through the liners thickness provides for a hard inner surface (for piston running) while also providing sufficient softness overall for the liner 10 to flex and otherwise adapt to external forces (such as engine block and/or head movement). The differential also allows machining of the outer surface of the liner 10, thus both lowering the cost of shape modification while increasing the number and type of shapes (in the preferred embodiment disclosed a cooling passage at the top outer edge of the liner).

In the preferred liner disclosed, the thinner cross-section and machinability of the liner allows cooling passages to extend higher and further neighboring the top flange (the brittleness and tendency to crack of a thorough hardened liner with/without sharp edges being absent).

The outer surface 23 of the wall 20 of the cylinder liner cooperates with the cylinder block 11 to radially support the cylinder liner 10 therein. In order to provide for efficient cooling of the cylinder liner wall 20, the outer surface 23 typically contacts the cylinder block at a limited number of points so as to allow for the location of coolant directly in contact with most of the outer surface 23. The coolant may be water based anti-freeze, oil or other fluid.

In the preferred embodiment, the liner 10 has coolant passages extending higher and deeper into the wall thereof. This allows for more efficient cooling in the most critical area of the liner, the firing zone 18 near the upper flange of the liner. This is especially important during the dwell time that the piston is at its uppermost position because it allows for the coolant passages to extend higher with greater volume than otherwise. This provides for a greater ring to coolant temperature thermal transfer. In addition, the rings can be located higher on the piston if desired. This reduces the relatively stagnant area surrounding the piston but above the rings (contrasted to a conventional engine) while also increasing the efficiency of thermal transfer radially through the liner 10.

It is preferred that the points of contact 25 between the cylinder liner 10 and the cylinder block 11 be limited in number, typically occurring at the upward extent 26 and lower extent 27 of the cylinder liner. Preferably the contact to the block at the firing zone 18 at the top of the cylinder liner 10 is sufficient to maintain the combustion pressures within the cylinder liner without the physical deformation of the liner. It is preferred that the two extents 26, 27 and the cooperating surfaces of the cylinder block 11 be sized so as to provide for a precise radial location of the cylinder liner 10 in respect to the cylinder block. This is not necessary that the remainder of the outer surface 23 of the cylinder liner wall 20. The two extents can be machined during the fitting of the liners 10 into the block. If appropriate, such machining may be accomplished in order to modify the cooling parameters of the coolant circulating outside of the cylinder liner wall 20 or to reduce/eliminate sharp edges (for example the extended wall section 25 later described). Physical seals, not shown, at the top and bottom of the liner serve to contain the fluid coolant between the block and liner 10.

It is preferred that the liner wall 20 have a generally nodule and ductile structure so as to provide for ease of machining during manufacture and for some flexing between the cylinder liner 10 and associated parts (engine block, head) in operation without cracking or otherwise compromising the physical integrity of the cylinder liner 10 (such as might occur during engine operation with a thorough hardened cylinder liner). This also forms the foundation for a liner having zones of differing hardness, thus to optimize the nature of the liner for its various functions. For example, instead of using a chilled cast iron construction (100% thorough hardness to 45-47 Rockwell C (hereinafter "RC")), the preferred embodiment has a relatively soft construction. The inner running surface induction hardened after machining to a depth of the total wall thickness from 10-40% (20-30% preferred). This makes the liner stronger and more adaptable to movement of the block and head while the engine is running. Note that a piston of two parts (steel on top, aluminum on bottom) could be utilized with the liner of this invention. The difference from a conventional liner including the possible location of the rings higher on the piston in the invention.

In the preferred embodiment of the present invention, the hardness differential allows for a hard inner running surface for the piston and relatively complex, machined outer surface with a coolant groove extending higher and deeper into a single liner. Further, the groove 50 can have a more versatile shape for enhanced cooling.

The liner preferably has a 18-24 RC hardness with the induction hardening increasing the hardness of the inner surface to 42-46 RC to 0.030" to 0.060" deep.

The flange 40 of the cylinder liner 10 serves to axially locate the cylinder liner 10 in position in respect to the cylinder block 11 and a cylinder head 12. To accomplish this, the flange typically has a lower surface 41 in contact with a mounting groove 44 in the cylinder block 11 and an upper surface 42 in physical contact with the lower portion 45 of the cylinder head 12. The contact between the flange 40 and these parts of the engine typically is a compression-type fit so as to tightly seal the top section of the combustion chamber 14 in respect to the cylinder head 12 while also serving to eliminate any axially movement of the wall 20 of the cylinder liner 10 in respect to the cylinder block 11 of the engine. This flange 40 may be located at the top of the liner 10 (as shown) or located downward of this location (preferably then as a step in the wall of the liner). Note that in the preferred embodiment, the radius of the cooling groove 50 merges with the lower outer edge surface of the flange 40 (a radius of 0.320 disclosed). This eliminates a sharp edge that would otherwise occur in a more conventional rectangular cooling groove, even if such groove was located lower on the flange. This radius also allows the groove to be located higher than otherwise.

The area neighboring this flange 40 typically is the upper edge of the firing zone 18 of the engine. The flange 40 thus can serve (with the engine block) to also strengthen the liner 10 against the outward pressures of combustion at this location. In an ideal world, there would be coolant extending immediately in contact with this firing zone 18 so as to remove the excessive temperature which would otherwise-occur at this location (most of the remainder of the contact between the wall 20 and the piston 13 are for the intake or discharge of the combustion gases and so do not have the high instantaneous temperature which occurs upon combustion in the firing zone 18 of the engine).

In the preferred embodiment of the invention of the present application, a curved coolant circulation chamber 50 is located in the cylinder liner 10 so as to provide for the location of coolant further upward and inward in respect to the firing zone 18 of the engine then would otherwise occur. Further, the curved nature of the cross-section provides for the efficient transfer of heat throughout the full extent of the groove, eliminating any corners that would restrict fluid passage by creating eddies and/or hot spots as well as moving the cross-section of the coolant groove higher in respect to the firing zone than otherwise. In addition to being more complex, this enhances the flow and uniformity of coolant while also reducing steam bubble formation. The curved shape also lessens the generation of cracks that might occur with sharp transitions at this location. (This in combination with the relative softness of the wall 20 of the liner lengthens the service life of the entire liner.)

The circulation groove 50 accomplishes its purpose of advanced cooling by extending further inward with a higher area further upward into the wall 20 of the cylinder liner 10 then previously accomplished. This is occasioned in the preferred embodiment based primarily on factors including: A) the circulation groove 50 extending higher in the liner to allow more thermal transfer at the uppermost positioning of the piston 13 than otherwise is possible; B) since the circulation groove 50 is of a generally rounded efficient curved shape, tight edges which would otherwise hinder fluid circulation and/or tend to initiate cracking, are eliminated; and, C) since the wall 20 of the cylinder liner 10 is of a soft, non-hardened, nodule cast iron through most of its radial extent from the outer surface 23 thereof, one is able to complete the curved groove 50 near between the flange 40 and the wall 20 of the cylinder liner 10 and most of the remainder of the surfaces at the top of the cylinder liner 10 by machining.

In respect to the higher extent of the circulation groove 50 in respect to the combustion chamber, the groove 50 is located closer to the top dead center positioning of the piston 13 with more fluid volume in a cleaner flow pattern. This allows for a better, more efficient thermal transfer from the piston (and especially its rings) to the coolant. This lengthens the service life of the engine and its cylinder liners by reducing the temperature differential along the axial length of the piston. This extends the operational life of the engine components between rebuilds while also allowing for more efficient operation. This is especially important in a diesel engine wherein the rod length/stroke ratio is usually better than 2.5 to one for an increased dwell interval at top dead center relative to crank rotation.

In respect to the shape of the circulation groove 50, generally rounded with no sharp edges, the groove 50 can have with a differential cross-section with its major portions located further axially upward and radially inward towards the firing zone 18 than would be possible with, for example, a straight rectangular single cross-section channel. By pulling the fluid high and in, a swirling flowpath is induced in the groove (this in contrast with the more laminar circumferential flow present in a rectangular groove). Due to this, coolant flow is also shifted towards the firing zone 18 thus increasing the transfer of temperature between the liner and the surrounding coolant fluid. In addition, the groove 50 also significantly reduces the thickness of the wall 20 (20% or more is possible, for example, in respect to an alternative rectangular section). This brings the coolant in the groove 50 further into closer proximity with the firing zone 18. This also increases the heat transfer characteristics, and thus the service life, of the liner 10. In addition, the outer surface of the piston including the curved groove 50 can be formed at a single machining location, further lowering the cost of the cylinder liner 10. This reduces the manufacturing costs of the liner in respect to alternative construction methods.

It is preferred that the fluid within the curved groove 50 have a pressure differential in respect to the remainder of the cooling passages in the engine (or at least of the point(s) of groove discharge), thus to further facilitate the heat transfer at this location by eliminating hot spots. This can be provided integrally with the engine, such as that which is present in the modern diesel engines set forth in the previously cited U.S. Pat. Nos. 3,365,608 and 5,299,538, through auxiliary passages cut into the outer surface 23 of the wall 20 of the cylinder liner 10, or otherwise as may be appropriate for a particular application. A higher pressure is preferred.

In addition to the above, the enlarged wall section 25 immediately below the curved groove 50 is extended further than the surrounding engine block support (see 31 in FIG. 3), and then to end in a taper 28 to blend in with the remainder and thinner portions of the cylinder wall. This enlarged section 25 and extension 28 reinforce the joint between the liner and the block by spreading the loads for a greater distance than would occur had the wall thickness of the liner been reduced abruptly at/near the block support 31. This reduces flexing of the liner 10 at this critical location, especially during the combustion cycling of the piston 13. It also avoids the concurrence of two separations of contact at a single location such as would occur if the cylinder wall were to be reduced in thickness at or immediately neighboring the location of its physical separation from the engine block. This further strengthens this area by allowing physical forces between the liner and block to transfer to a uniform wall thickness liner. The taper 28 aids in this by eliminating any abrupt changes in thickness. In addition, all other outer edges can be radiused in the same machining operation. This reduces differential points for initiating the cracking and fracturing at other parts of the liner.

The preferred cylinder liner 10 shown is 5.825" in diameter and 10.995" long for use as a 5.120" bore liner. The flange 40 extends to 6.167" total diameter (a 0.171" extension) and is 0.353" in depth beginning some 0.050" below the top of such liner. The top of the cylinder wall is expanded from 5.825" to 5.865" in diameter some 1.62" from the top of the liner, terminating in a 5° angle taper to such location. The circular groove 50 has a radius of 0.320" and a total width of 0.472" with the ends radiused by 0.030". Most of the cylinder liner wall 20 has a hardness of 18-24 RC with the inner surface 23 hardened to 42-46 RC. The inner surface 23 is induction hardened to 42-46 RC some 0.030" to 0.080" inwards in the wall of such liner. The top of the liner can also be hardened after machining (for example to 42-46 RC). The invention is particularly suitable and synergically combines with the One Piece Investment Cast Piston application Ser. No. 10/973,006 filed Oct. 25, 2004 and the Investment Cast Two Piece Piston application Ser. No. 10/972,824 filed Oct. 25, 2004, the contents of which-are included by reference.

In other installations, these dimensions and the hardness of the liner 10 and the pistons 13 would vary. For example, FIG. 3 of the present application discloses the liner 10 of the invention utilized as a repair liner in on a type of engine block (similar to a Detroit diesel). This liner could, with appropriate modifications, be used in a differing engine block (FIG. 4 similar to Mercedes). As the liner 10 can have a machined outer surface, it can be easily adapted to differing blocks.

Figure 3:
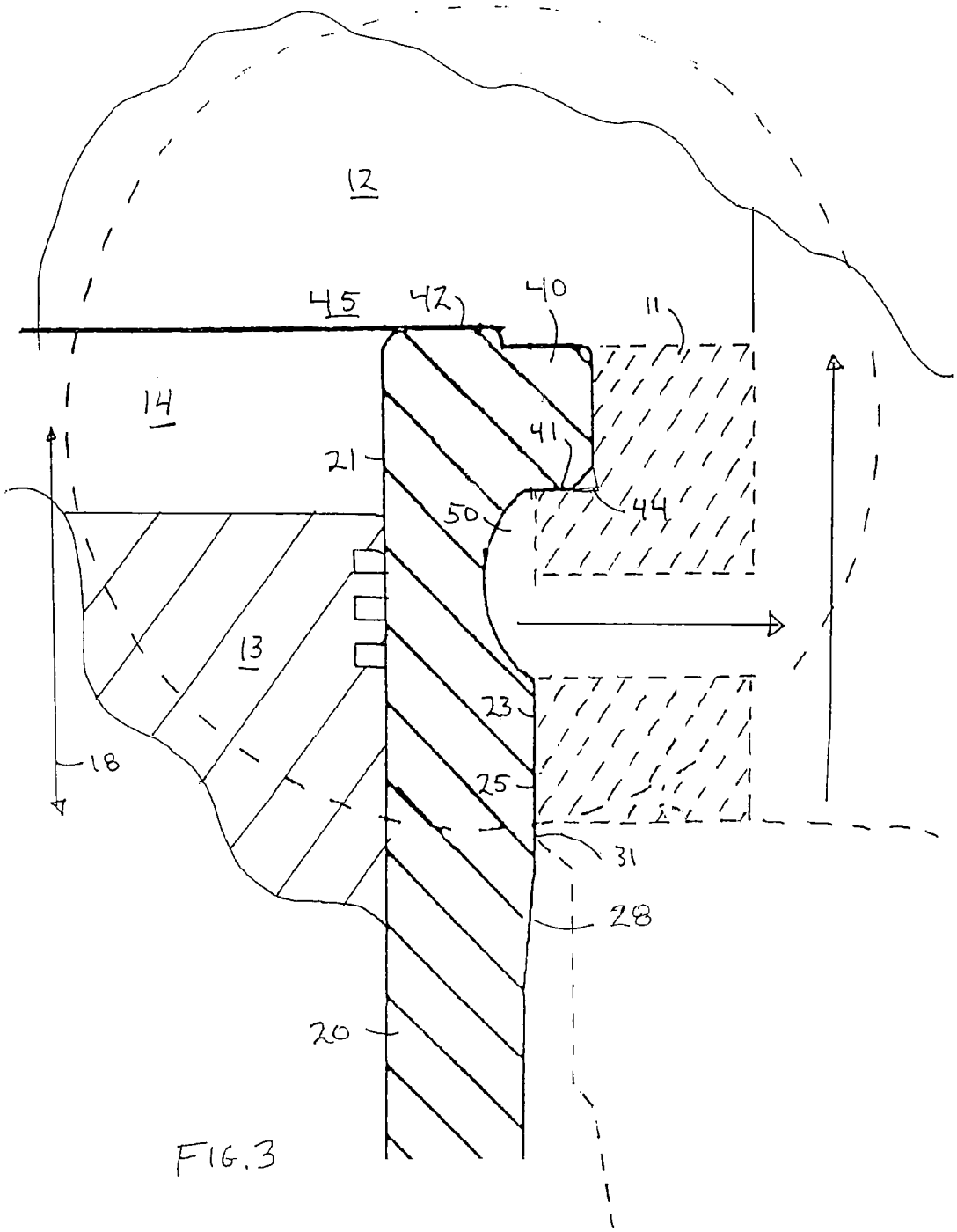
FIG. 3 is a drawing of FIG. 2 in location in an example engine block.
Figure 4:
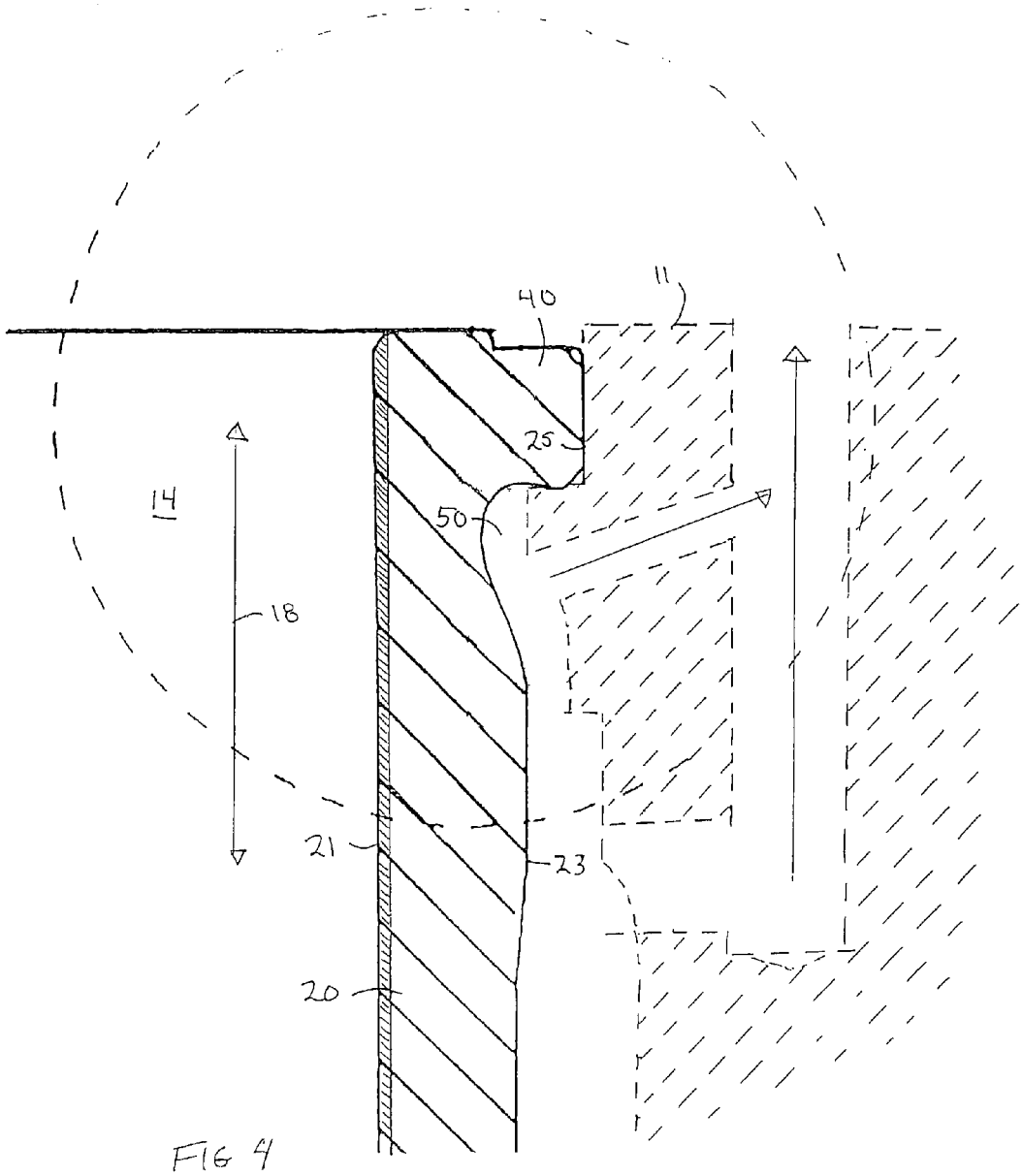
FIG. 4 is a drawing of the top of an alternate embodiment of the cylinder liner similar to FIG. 2 in a differing engine block with a representation of the induction hardening which is present in the cylinder liner; and, FIG. 5 is a drawing like FIG. 1 of an alternate parabolic chamber together with a turning tool highlighting a method of manufacture thereof.
Figure 5:
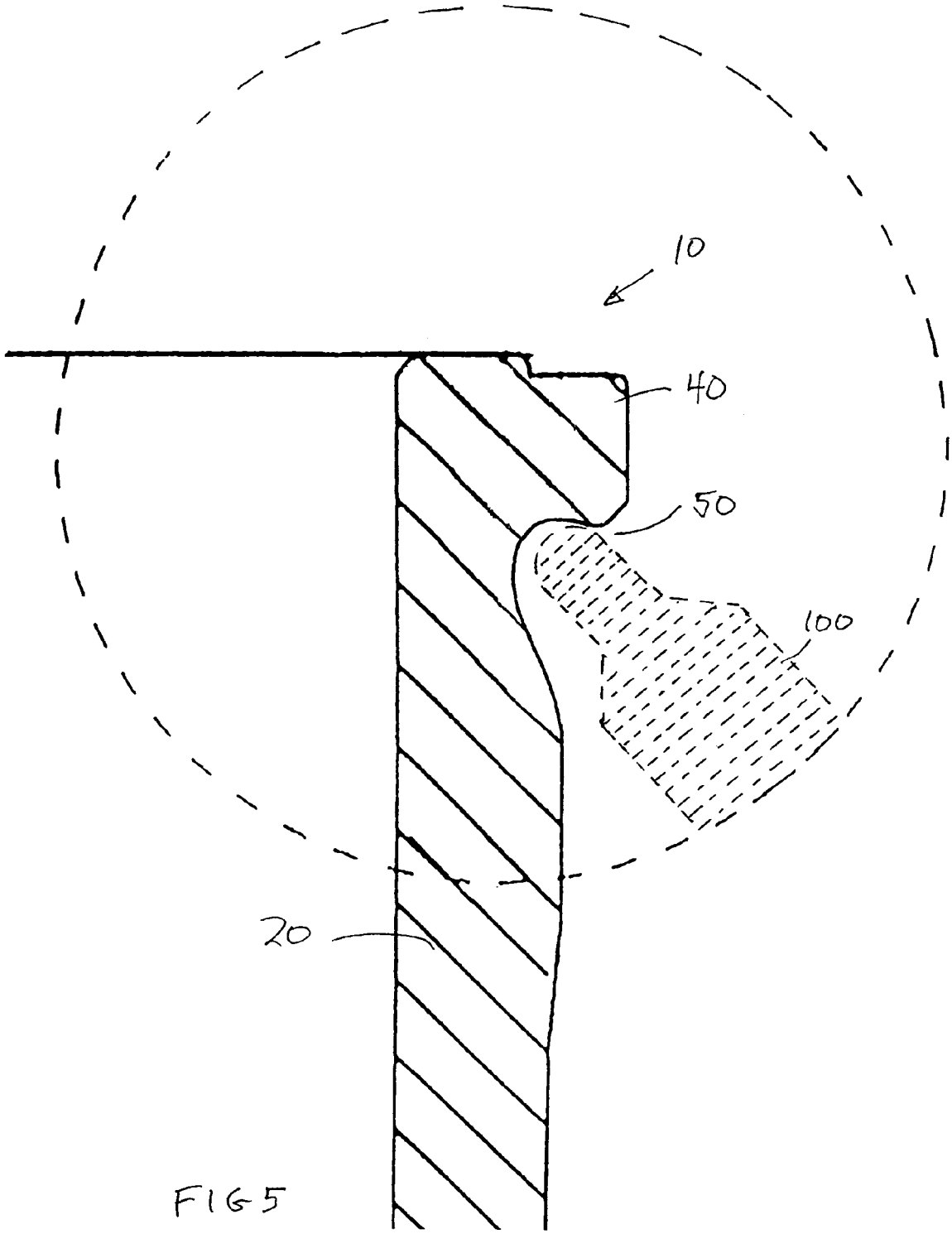

Additional example, the cooling groove 50 can utilize a parabolic type curvature or other complex shape due to the preferred machining step of soft iron for the outer extent of the liner (contrast FIG. 4 with FIG. 3). This can simultaneously reduce cracking or fatigue breaking of the liner while also increasing the thermal transfer efficiency between the piston and coolant. Further, this machining can occur with a simple set up of the liner. In addition to physical shape, different hardening of the liner could also be occasioned.

Therefore, although this invention has been described in its preferred form with a certain degree of particularity, numerous changes can be made without deviating from the following invention.

What is claimed:

1. In an internal combustion engine having a cylinder block, a cylinder head, and a cylinder liner received in a bore of said cylinder block to form a combustion chamber, with a top of said cylinder liner neighboring a firing zone of said combustion chamber, said cylinder liner comprising:

a radial mounting flange received in a mounting groove in the cylinder block, the mounting flange having a lower surface in contact with said cylinder block and an upper surface in contact with said cylinder head in a compression-type fit between the cylinder block and the cylinder head to axially locate the cylinder liner with respect to the cylinder block and cylinder head; and a cylinder wall having an internal and an external surface, said cylinder wall having a cooling groove having a curved cross-section in said external surface adjacent said mounting flange, wherein the curved cross-section of the cooling groove directly merges with the lower surface of the mounting flange.

2. The cooling groove of claim 1 characterized in that the cylinder liner has a reduced hardness at said cooling groove.

3. The cooling groove of claim 1 characterized in that the inner surface of the cylinder liner is hardened.

4. The liner of claim 1 wherein the liner wall further comprises an enlarged liner wall section, wherein the liner wall is reduced by a taper to the remainder of the liner wall.

5. The liner of claim 4 characterized in that the surrounding cylinder block has a bore with a diameter and the diameter of said enlarged liner wall section substantially equalling the diameter of the bore in the cylinder block.

6. The liner of claim 5 characterized in that the surrounding cylinder block has a length of contact with said enlarged liner wall section and the length of said enlarged liner wall section being longer than said length of contact.

7. A method of manufacturing a cylinder liner for use in an internal combustion engine having a cylinder block and a cylinder head, said method comprising:

forming a cylinder liner wall having a generally nodule and ductile structure;

machining the inner and the outer surface of the liner, the outer surface including a radially extending mounting flange having a lower surface configured to contact the cylinder block and an upper surface configured to contact the cylinder head in a compression-type fit between the cylinder block and the cylinder head to axially locate the cylinder liner with respect to the cylinder block and cylinder head, and a coolant circulation chamber on the upper end thereof, the coolant circulation chamber having a curved, non-rectangular cross-section, wherein the curved cross-section of the coolant circulation chamber is machined to directly merge with the lower surface of the mounting flange without; and hardening the inner surface of the liner wall.

8. The method of claim 7 characterized in that the curve is parabolic.

9. The method of claim 8 characterized in that the hardening of the inner surface is accomplished by induction.

10. The method of claim 7 characterized in that the hardening of the inner surface of the liner wall is accomplished before the machining of the outer surface of the liner.

11. The method of claim 7 characterized in that the hardening of the inner surface of the liner wall is accomplished after the machining of the outer surface of the liner.

12. The method of claim 7 characterized in that the coolant circulation chamber is machined to be generally rounded.

13. The method of claim 12 characterized in that the coolant circulation chamber is machined as a curved groove.

14. The method of claim 7 wherein the inner surface is induction hardened after machining to a depth of 10-40% of the total liner thickness and the outer surface is not hardened.

15. The method of claim 7 wherein the liner has an RC hardness between 18 and 24 with the hardness of the inner surface increased to between 42 and 46 by induction hardening.

16. The method of claim 7 wherein the inner surface of said cylinder liner is induction hardened to 0.030" to 0.060" deep.

17. A replaceable cylinder liner for use with an internal combustion engine, the cylinder liner having a top section neighboring a firing zone having a circumferential flange and a cooling groove, the circumferential flange being greater in diameter than the outside diameter of other portions of said cylinder liner and is configured to be received by the engine block in a compression fit, wherein the circumferential flange has a solid cross-section such that it does not contain a circumferential groove or sealing ring therein, and wherein the cooling groove is located below the circumferential flange and has a curved, non-rectangular cross section.

18. The cylinder liner of claim 17 wherein the groove has a shape that is semi-circular, hyperbolic, elliptical, or parabolic.

19. The cylinder liner of claim 17 wherein the inner surface of said cylinder liner is hardened.

20. The cylinder liner of claim 19 wherein the inner surface is induction hardened after machining to a depth of 10-40% of the total liner thickness and the outer surface is not hardened.

21. The cylinder liner of claim 19 wherein the liner has an RC hardness between 18 and 24 with the hardness of the inner surface increased to between 42 and 46 by induction hardening.

22. The cylinder liner of claim 21 wherein the inner surface of said cylinder liner is induction hardened to 0.030" to 0.060" deep.

23. A method of manufacturing a cylinder liner, said method comprising:

forming a cylinder liner wall having a generally nodule and ductile structure;

machining the inner and the outer surface of the liner, the outer surface including a coolant circulation chamber on the upper end thereof; and hardening the inner surface of the liner wall, wherein the hardening of the inner surface of the liner wall is accomplished before the machining of the outer surface of the liner.

* * * * *